US007975518B2

(12) United States Patent
Chiang et al.

(10) Patent No.: US 7,975,518 B2
(45) Date of Patent: Jul. 12, 2011

(54) RE-KEYABLE LOCK WITH IMPROVEMENTS FOR PREVENTING INCOMPLETE RE-KEYING

(75) Inventors: Wei-Liang Chiang, Chiayi (TW); Ju-Lin Yang, Chiayi (TW); Rong-Faa Wu, Chiayi (TW); Ching-Chuan Kuo, Chiayi County (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 398 days.

(21) Appl. No.: 12/165,694

(22) Filed: Jul. 1, 2008

(65) Prior Publication Data

US 2009/0007615 A1 Jan. 8, 2009

(30) Foreign Application Priority Data

Jul. 2, 2007 (TW) ..... 96210819 U

(51) Int. Cl.
*E05B 25/00* (2006.01)

(52) U.S. Cl. ..... 70/383; 70/492

(58) Field of Classification Search ..... 70/383–385, 70/492, 495, 369

See application file for complete search history.

(56) References Cited

U.S. PATENT DOCUMENTS 3,099,151 A * 7/1963 Schlage ..... 70/383
3,172,284 A * 3/1965 Crandell et al. ..... 70/383
3,191,407 A * 6/1965 Spon ..... 70/383
3,210,973 A * 10/1965 Basseches ..... 70/383
3,257,831 A * 6/1966 Schlage ..... 70/383
3,395,558 A * 8/1968 Russell et al. ..... 70/493
4,185,480 A * 1/1980 Pechner ..... 70/358
4,850,210 A * 7/1989 Adler et al. ..... 70/383
5,325,690 A * 7/1994 Adler et al. ..... 70/383
5,752,400 A * 5/1998 Kim ..... 70/368
6,871,520 B2 * 3/2005 Armstrong et al. ..... 70/492
6,968,717 B2 * 11/2005 Suzuki et al. ..... 70/492
7,007,528 B2 * 3/2006 Chong et al. ..... 70/492
7,448,240 B1 * 11/2008 Huang et al. ..... 70/492
7,584,635 B2 * 9/2009 Gan et al. ..... 70/338
7,634,930 B2 * 12/2009 Boesel et al. ..... 70/383
2008/0264127 A1 * 10/2008 Chiang et al. ..... 70/492
2009/0277239 A1 * 11/2009 Mathachan ..... 70/383

* cited by examiner

*Primary Examiner* — Suzanne D Barrett

(74) *Attorney, Agent, or Firm* — Chun-Ming Shih

(57) ABSTRACT

A re-keyable cylinder lock includes a plug inserted into a lock housing and having a plurality of radial holes connected to a key hole. The lock housing has a first engaging element provided in an inner surface thereof. A limit unit has a second engaging element and is inserted into one of the radial holes located at a predetermined depth of the key hole. The first engaging element engages the second engaging element to limit the plug from rotating when a replacement key which is inserted into the key hole for re-keying does not reach a predetermined depth of the key hole. Incomplete re-keying can therefore be prevented.

9 Claims, 12 Drawing Sheets

RE-KEYABLE LOCK WITH IMPROVEMENTS FOR PREVENTING INCOMPLETE RE-KEYING

CROSS-REFERENCE TO RELATED APPLICATION

This application claims priority of Taiwanese Invention Patent Application No. 096210819 filed on Jul. 2, 2007.

BACKGROUND OF THE INVENTION

1. Field of the Invention

This application relates to a re-keyable cylinder lock, more particularly to an improvement that provides a re-keyable cylinder lock with a limit unit inserted into one of a plurality of radial holes located at a predetermined depth of a key hole.

2. Description of the Related Art

Re-keyable cylinder locks are well known in the art. Examples of the re-keyable cylinder locks are disclosed in U.S. Pat. Nos. 6,862,909 and 6,871,520. Such cylinder locks can be re-keyed using a new replacement key to replace an old key, without disassembling components of the cylinder locks. A method of re-keying includes inserting the replacement key into a key hole in the cylinder lock after the old key inserted therein is pulled out of the key hole. The insertion of the replacement key repositions tumbler pieces of the cylinder lock relative to a key bit of the replacement key so that orientations of the tumbler pieces are changed.

For re-keying, it is necessary that the key bit of the replacement key inserted into the key hole must reach a predetermined depth of the key hole. Otherwise, the tumbler pieces cannot be entirely re-oriented, and the re-keying cannot be completed. In case of incomplete re-keying, all steps of the re-keying have to be repeated, which is very inconveniences. A solution to the problem of incomplete re-keying is therefore desirable.

On the other hand, it is known to provide a re-keyable cylinder lock with a re-keying unit that can engage tumbler pieces so as to position the same in a pre-determined orientation and that can disengage from the tumbler pieces to permit the tumbler pieces to change in position so as to match a replacement key. When the re-keying unit engages the tumbler pieces, the cylinder lock cannot be re-keyed, but can be placed in a locking position using a valid key to lock a plug of the cylinder lock against rotation so that a door can be locked. When the re-keying unit disengages from the tumbler pieces, the cylinder lock can be re-keyed using a replacement key to change the orientation of the tumbler pieces. At this state, the plug can be rotated, but cannot be prevented from rotation.

SUMMARY OF THE INVENTION

An object of the present invention is to provide a re-keyable cylinder lock that can prevent rotation of a plug of the cylinder lock when a new replacement key which is inserted into the cylinder lock for re-keying does not reach a predetermined depth of a key hole and when a re-keying unit disengages from tumbler pieces for re-keying, thereby avoiding incomplete re-keying.

Accordingly, the present invention provides a cylinder lock that can be re-keyed using a replacement key to replace an old key and that comprises: a lock housing having a plug hole, and at least one first engaging element; and a plug inserted into the plug hole, and having an axially extending key hole, and a plurality of radial holes connected to the key hole. One of the radial holes is located at a predetermined depth of the key hole. The cylinder lock further comprises a plurality of tumbler pieces, a re-keying unit, and a limit unit. The tumbler pieces are inserted into the radial holes except the one radial hole and each have a toothed part. The re-keying unit is disposed within the plug hole adjacent the plug. The re-keying unit is movable relative to the plug between a first position in which the re-keying unit engages the toothed parts of the tumbler pieces to position the tumbler pieces, and a second position in which the re-keying unit disengages from the toothed parts to permit the tumbler pieces to change in position. The limit unit is inserted into the one of the radial holes and has at least one second engaging element. The first engaging element is engageable with the second engaging element when the re-keying unit is in the second position so that the plug is prevented from rotating when the replacement key which is inserted into the key hole for re-keying does not reach a predetermined depth of the key hole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
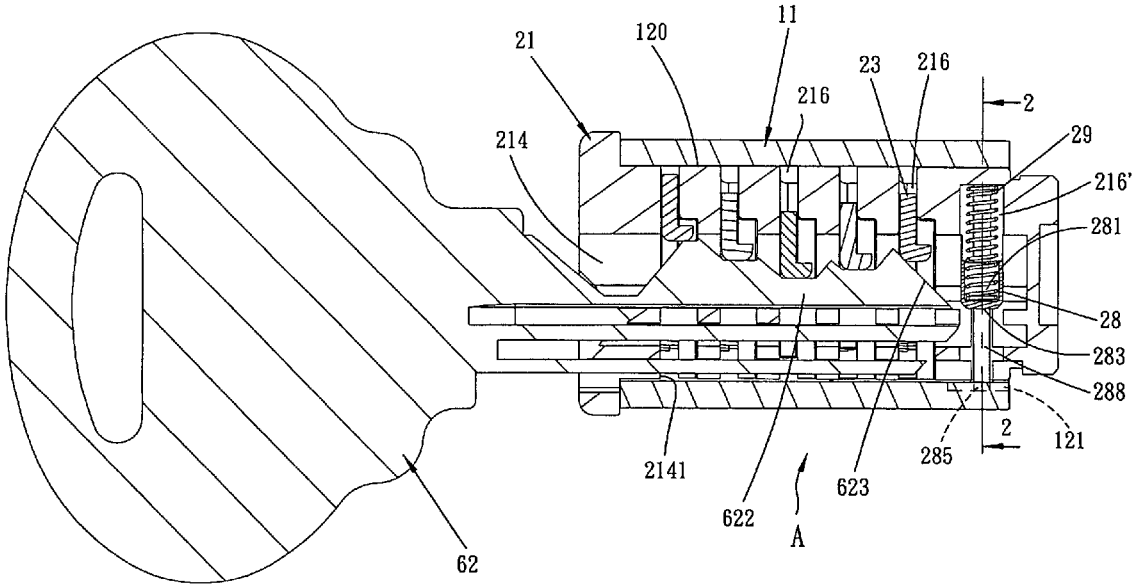
FIG. 1 is a sectional view of a re-keyable cylinder lock incorporating a first preferred embodiment of the present invention.
Figure 2:
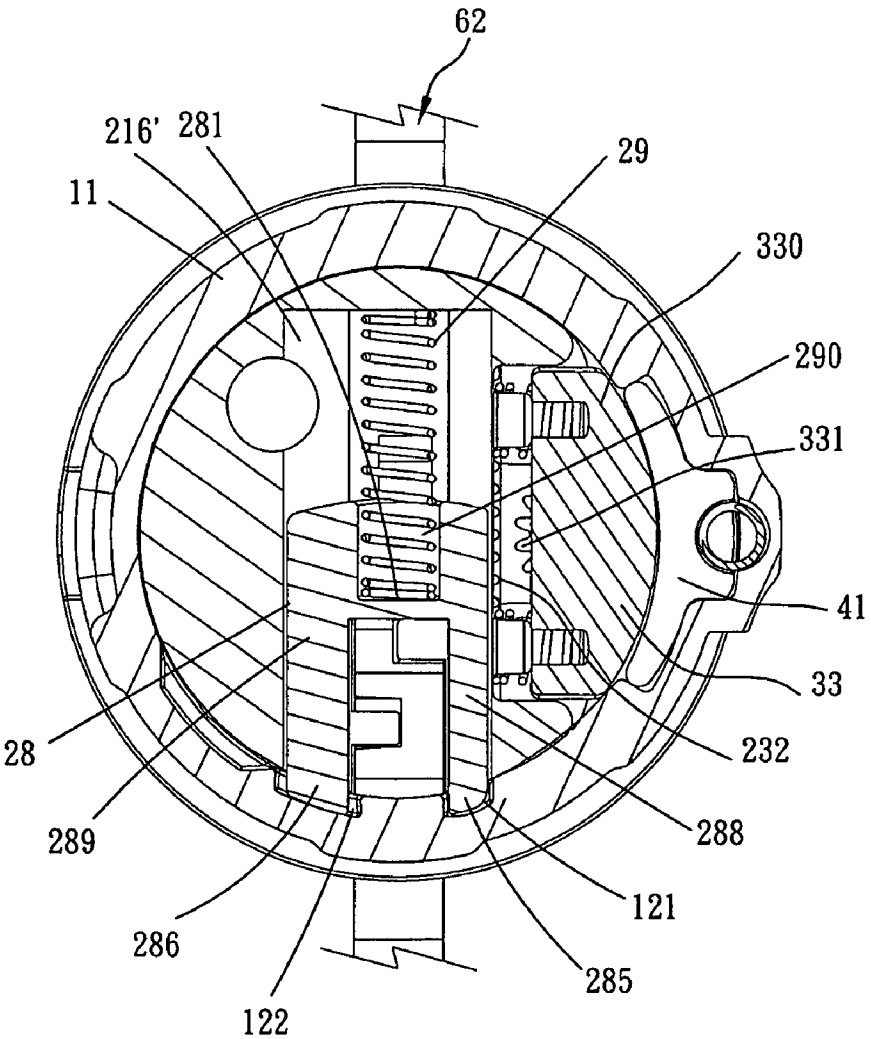
FIG. 2 is a sectional view taken along line 2-2 of FIG. 1.
Figure 3:
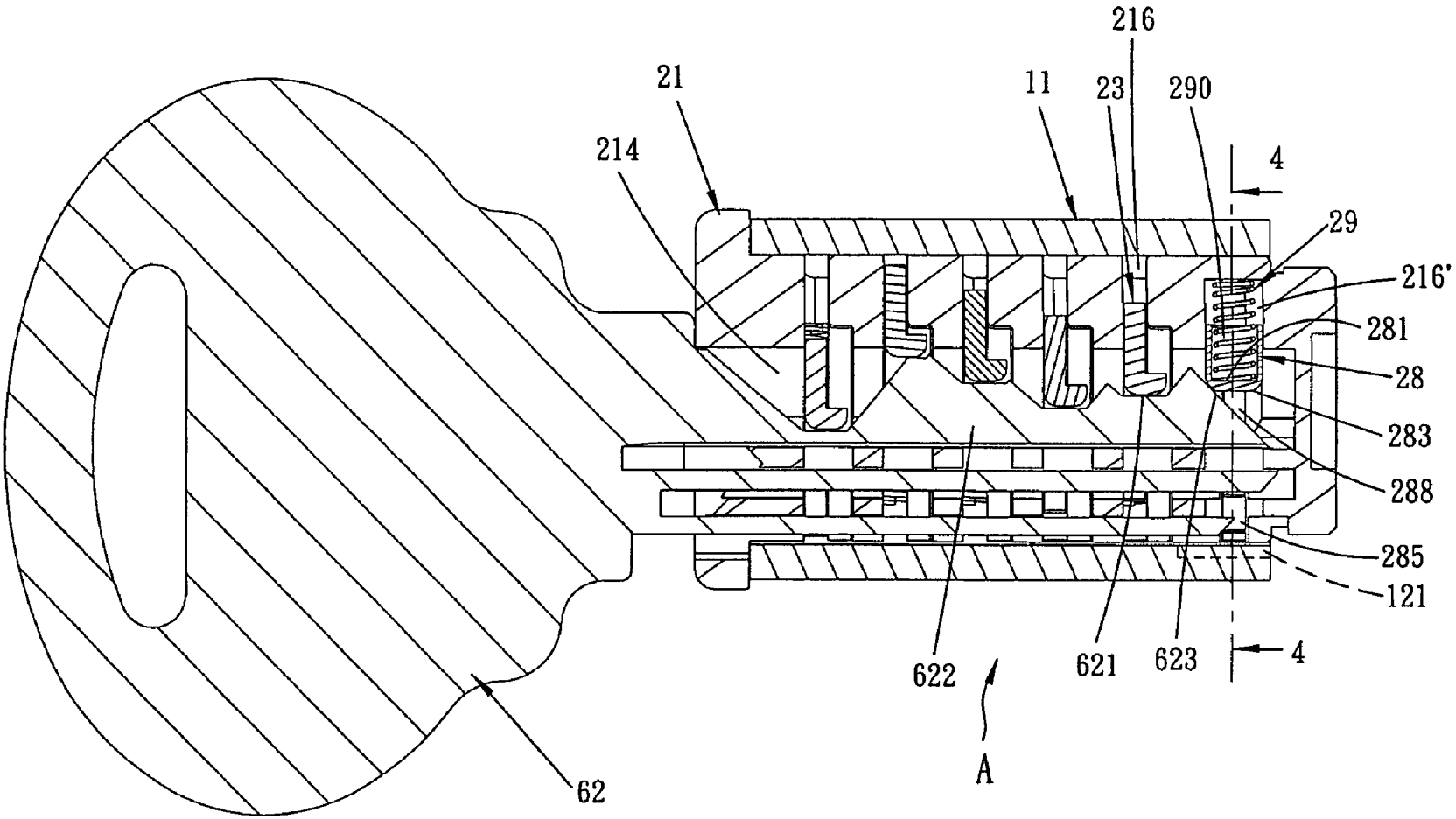
FIG. 3 is the same view as FIG. 1 but showing that a second engaging element is moved upward by a replacement key.
Figure 4:
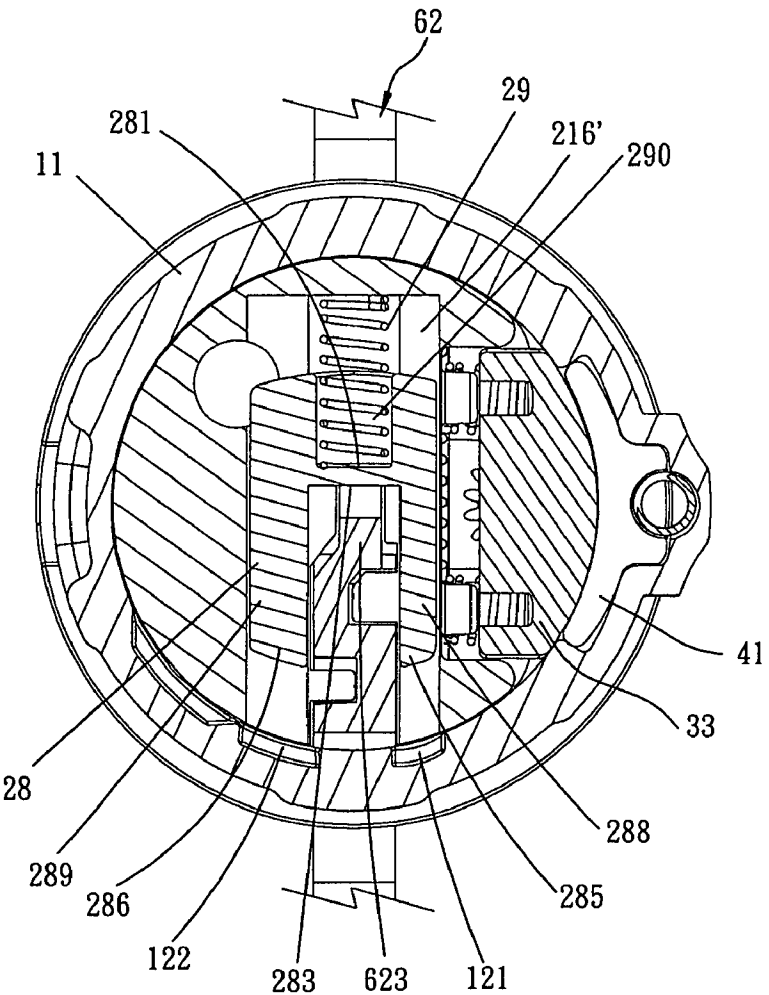
FIG. 4 is a sectional view taken along line 4-4 of FIG. 3.
Figure 6:
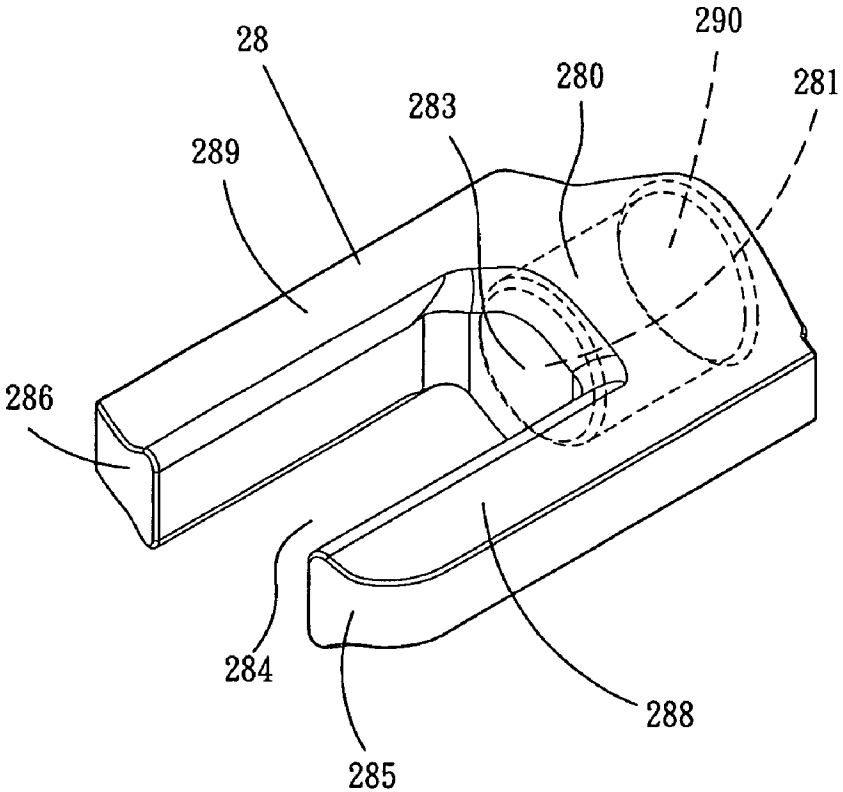
FIG. 6 is a perspective view of a limit unit.

Before the present invention is described in greater detail, it should be noted that same reference numerals have been used to denote like elements throughout the specification.

Referring to FIGS. 1-6, there is shown a re-keyable cylinder lock (A) that can be re-keyed using a new replacement key 62 to replace an old key (not shown) and that incorporates a first preferred embodiment of the present invention. A detailed construction of the re-keyable cylinder lock is described in a co-pending application filed by the applicant of this application, i.e., U.S. patent application Ser. No. 11/972,961 filed on Jan. 11, 2008, the content of which is hereby incorporated by reference into this specification.

Figure 5:
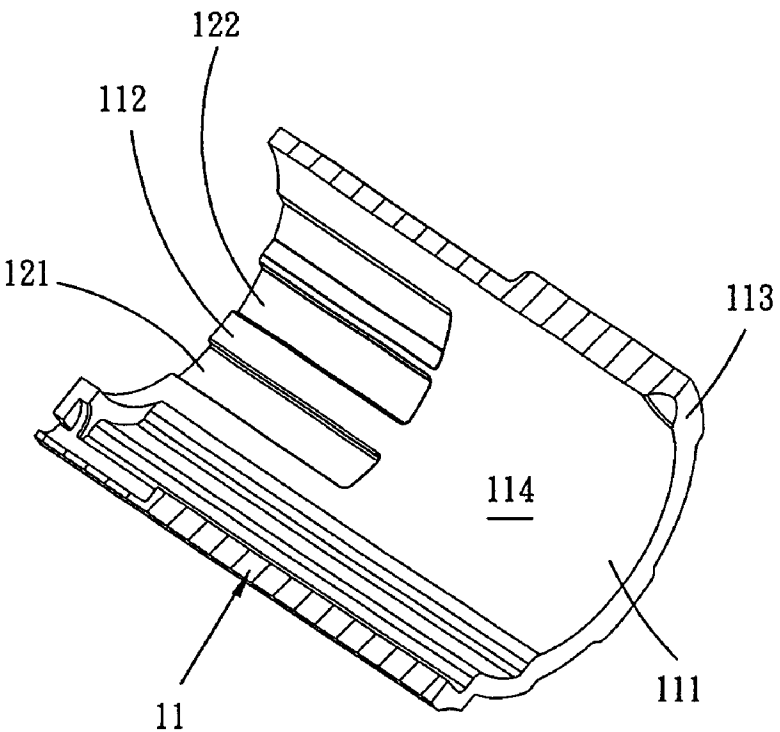
FIG. 5 is a fragmentary perspective view of a lock housing.

As shown in FIGS. 1-6, the re-keyable cylinder lock includes a lock housing 11 having a plug hole 120 that receives a plug 21. The lock housing 11 includes a cylindrical wall 113 having a first end 111, a second end 112, and an inner surface 114 that extends between the first and second ends 111 and 112 to define the plug hole 120. The inner surface 114 has two first engaging elements which are formed as grooves 121, 122 that extend from a middle of the inner surface 114 to the second end 112 as best shown in FIG. 5.

The plug 21 has an axially extending key hole 214 and a plurality of axially aligned radial holes 216 connected to the key hole 214. One of the radial holes 216 which is specifically denoted by numeral 216' is located at a predetermined depth of the key hole 214. In this embodiment, the radial hole 216' is nearer to an innermost end of the key hole 214 than the remaining radial holes 216 and is located at a predetermined depth of the key hole 214 where a slanting end face 623 of the replacement key 62 can reach when the replacement key 62 is inserted into the key hole 214. The key hole 214 has an axially extending open end 2141 that opens at an outer surface of the plug 21 and that faces the inner surface 114 of the lock housing 11.

Figure 7:
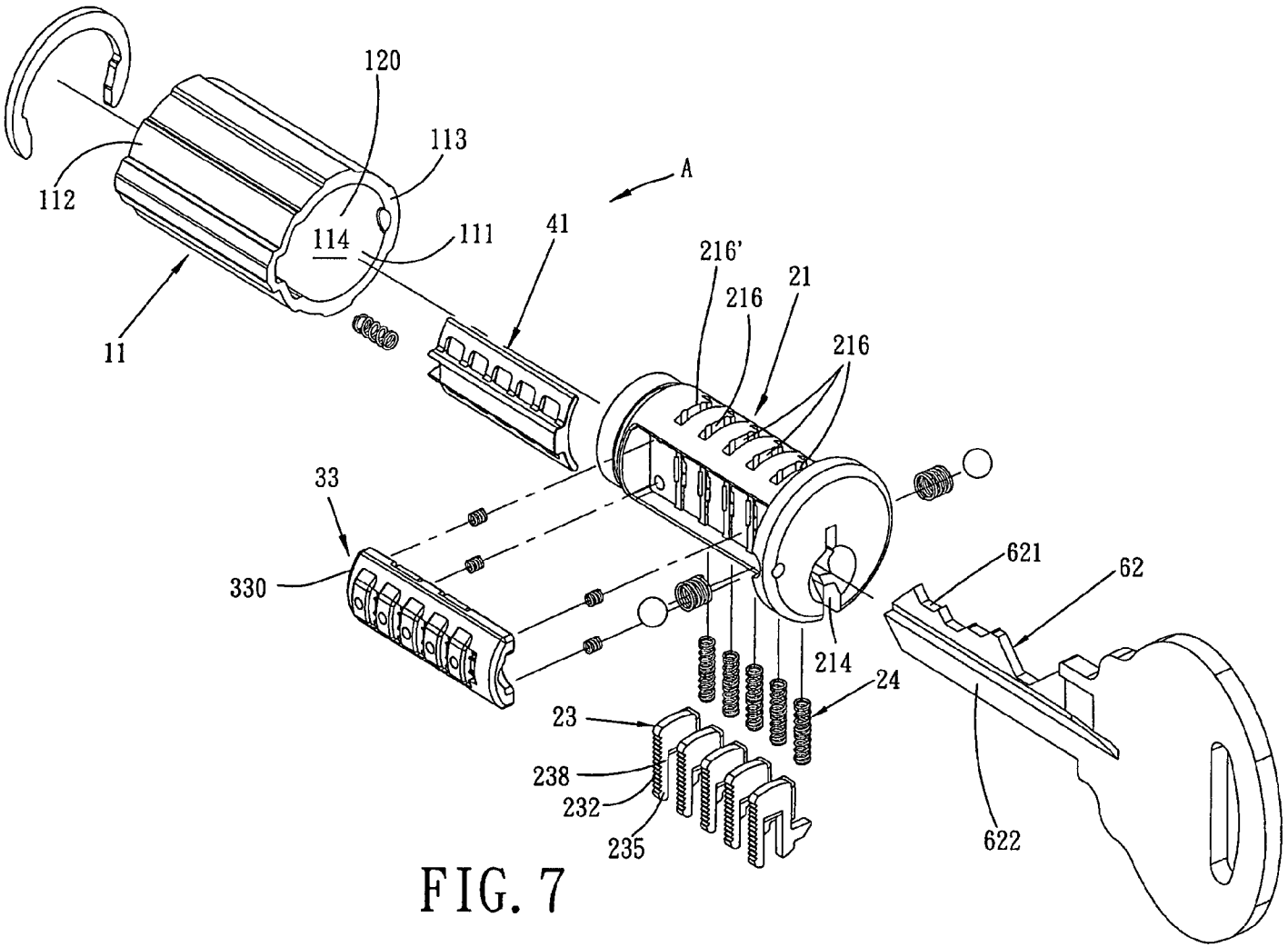
FIG. 7 is an exploded view illustrating a second preferred embodiment of the present invention.
Figure 10:
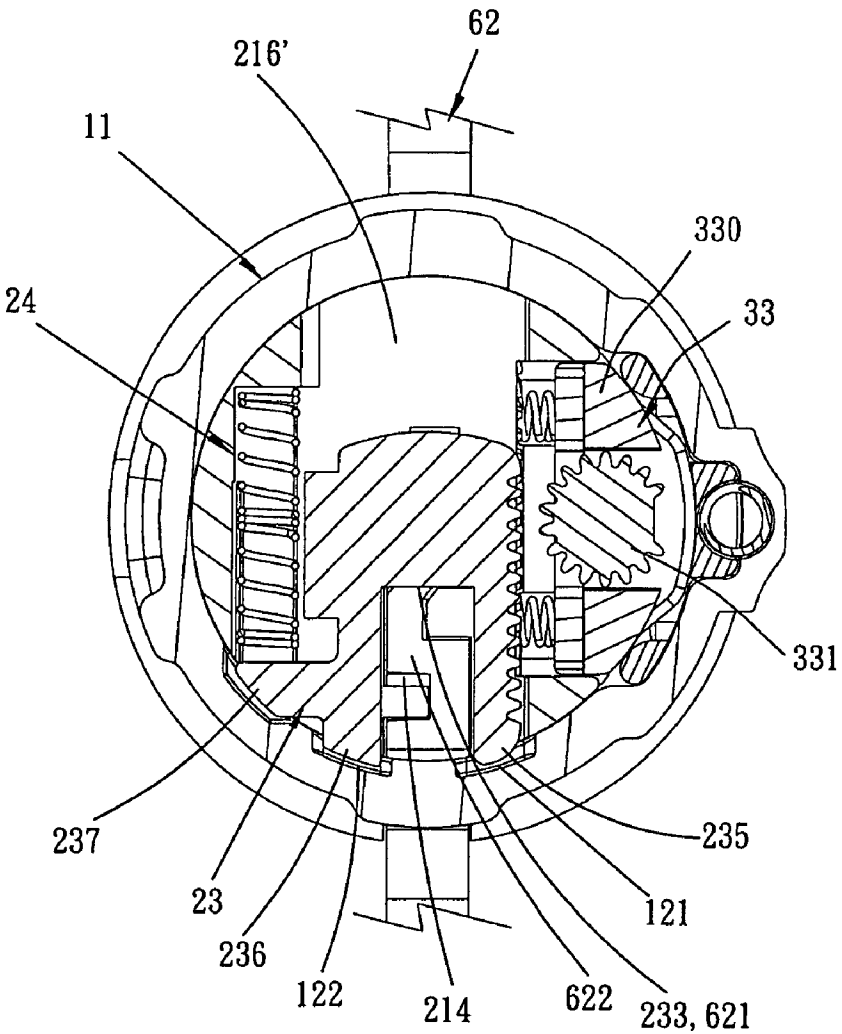
FIG. 10 is a sectional view taken along lines 10-10 of FIG. 9.
Figure 11:
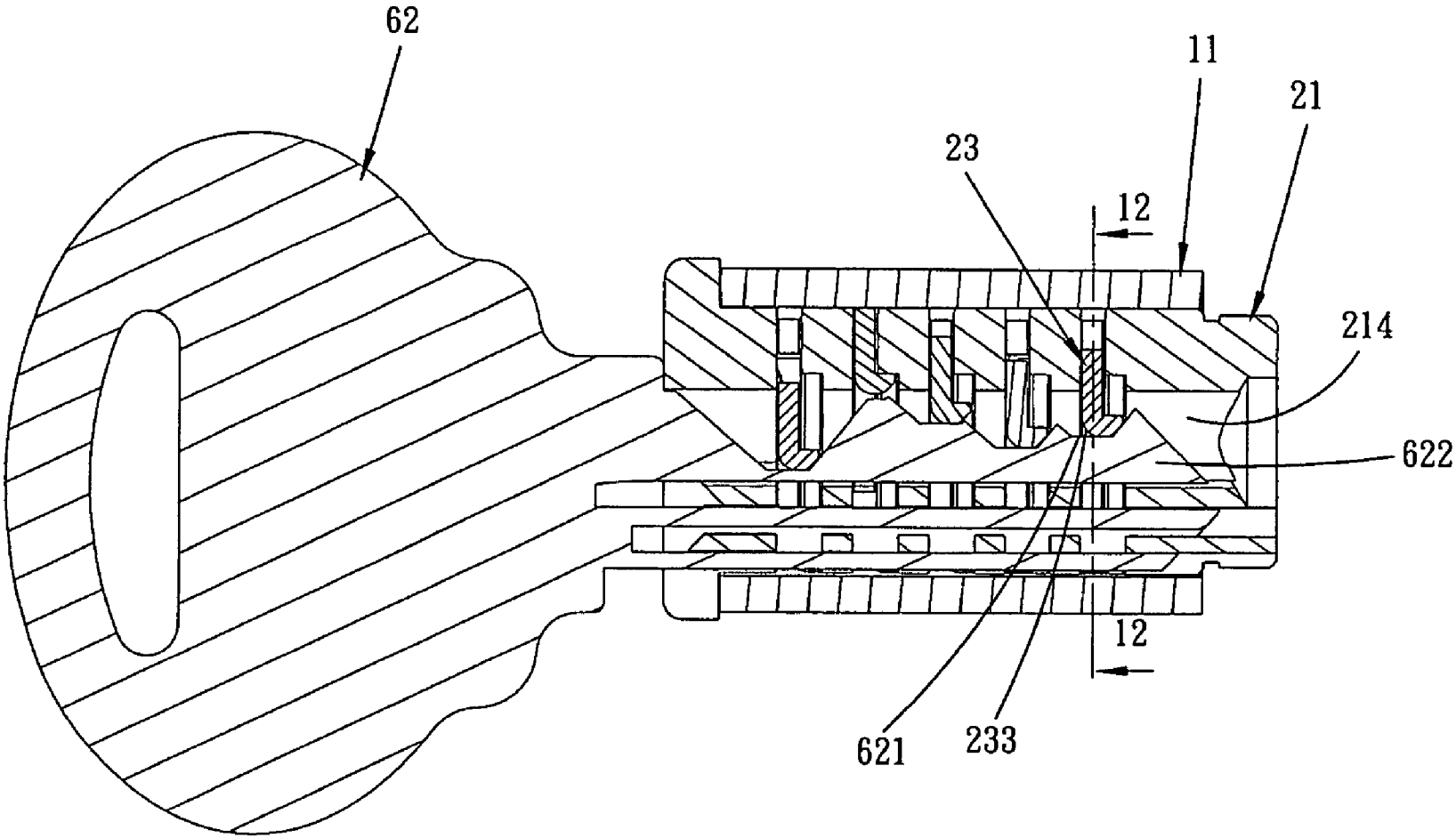
FIG. 11 is the same view as FIG. 9 but showing that the second engaging element is moved upward by the replacement key.
Figure 12:
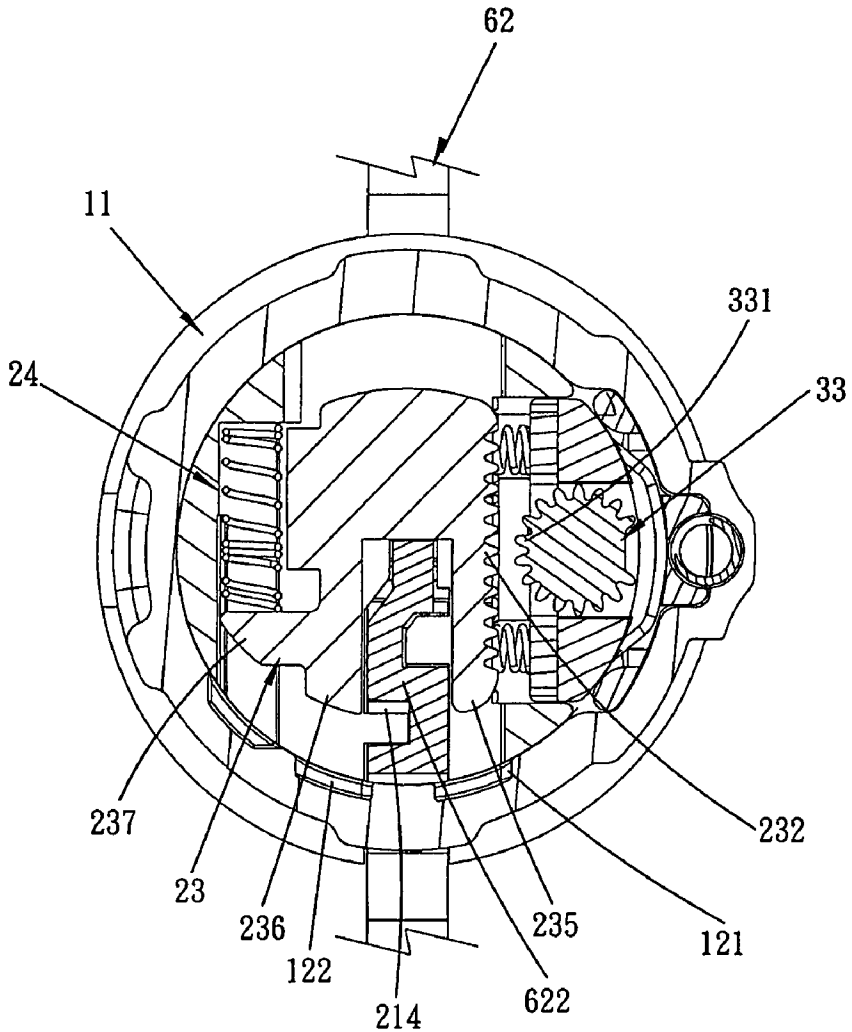
FIG. 12 is a sectional view taken along line 12-12 of FIG. 11.

The cylinder lock (A) further includes a plurality of tumbler pieces 23, a re-keying unit 33, and a control bar 41. The tumbler pieces 23 are disposed respectively in the radial holes 216 except the radial hole 216' and extend into the key hole 214. Each tumbler piece 23 has a toothed part 232 (also shown in FIGS. 7 and 8). The re-keying unit 33 (also shown in FIGS. 7 and 10) has a gear holder 330 holding a plurality of gear wheels 331 each of which engages releasably the toothed part of one of the tumbler pieces 23. The constructions of the tumbler pieces 23, the re-keying unit 33 and the control bar 41 are disclosed in the above-mentioned co-pending application of the applicant, and the details thereof are omitted herein for the sake of simplicity.

The gear holder 330 is movable transversely relative to the plug 21 between a first position in which the gear wheels 331 of the re-keying unit 33 engage the respective toothed parts 232 of the tumbler pieces 23 to position the tumbler pieces 23, and a second position in which the gear wheels 331 disengage from the respective toothed parts 232 to permit the tumbler pieces 23 to change in position when the replacement key 62 is inserted into the key hole 214.

The control bar 41 (also shown in FIGS. 7 & 10) is movable longitudinally so as to control the transverse movement of the gear holder 330 and the gear wheels 331. When the control bar 41 is moved rearward and longitudinally, the re-keying unit 33 is placed in the second position where the gear holder 330 is moved away from the tumbler pieces 23 and the gear wheels 331 disengage from the respective toothed parts 232. When the control bar 41 moves forward, the re-keying unit 33 is placed in the first position where the gear holder 330 is moved to the tumbler pieces 23 and the gear wheels re-engage the respective toothed parts 232. The operation of the control bar 41 is detailed in the above-mentioned co-pending application.

A limit unit 28 is disposed movably and radially in the radial hole 216' and extends into the key hole 214. The limit unit 28 has a middle part 280 with a middle hole 290, two opposite legs 288, 289 projecting from the middle part 280 and defining a key passage 284 therebetween, a key contact side 283 disposed on the middle part 280 adjacent the key passage 284, and a biasing spring 29 inserted into the middle hole 290 to push a bearing face 281 of the middle part 280.

According to the first preferred embodiment of the present invention, the limit unit 28 is provided with two second engaging elements 285, 286 which are formed respectively at the ends of the legs 288, 289. The second engaging elements 285, 286 are engageable with the first engaging elements or grooves 121, 122 to limit the plug 21 from rotating when the slanting end face 623 of the replacement key 62 does not reach the desired depth of the keyhole 214. The second engaging elements 285, 286 are disengageable from the first engaging elements 121, 122 when the limit unit 28 is pushed by the replacement key 62.

The radial hole 216' and the first engaging elements or grooves 121, 122 are disposed on two opposite sides of the key hole 214. The first engaging elements or grooves 121, 122 are formed in the inner surface 114 of the lock housing 11 and are proximate to the axially extending open end 2141 of the key hole 214. The limit unit 28 is normally biased by the biasing spring 29 so that the second engaging elements 285, 286 are extendable through the axially open end 2141 to engage the respective grooves 121, 122.

Referring back to FIGS. 1 and 2, the replacement key 62 is inserted into the key hole 214 in the cylinder lock (A) to re-key the cylinder lock (A). In this re-keying state, the gear wheels 331 of the re-keying unit 33 disengage from the respective toothed parts 232 of the tumbler pieces 23 so that the toothed parts 232 can be repositioned relative to the key bit 622 of the replacement key 62. However, if the key bit 622 is not completely inserted into the key hole 214 (i.e., only a part of the key bit 622 is inserted into the key hole 214), the slanting end face 623 of the replacement key 62 is unable to push the key contact side 283 of the limit unit 28 upward. As such, the second engaging elements 285, 286 cannot disengage from the respective first engaging elements 121, 122, and the plug 21 cannot be rotated by turning the replacement key 62 when the replacement key 62 is not properly and completely inserted into the keyhole 214. The locking of the plug 21 against rotation during re-keying will alert the user that the replacement key 62 should be pushed further into the key hole 214 to complete re-keying.

Referring back to FIGS. 3 and 4, when the key bit 622 of the replacement key 62 is completely inserted into the key hole 214, the key bit 622 reaches a predetermined depth of the key hole 214. At this state, the slanting end face 623 of the replacement key 62 pushes the key contact side 283 of the limit unit 28 upward so that the second engaging elements 285, 286 disengage from the respective first engaging elements or grooves 121, 122 and the plug 21 can be rotated by turning the replacement key 62. Completion of the re-keying operation can therefore be assured. Relevant details of the re-keying operation are disclosed in the above-mentioned co-pending application.

Figure 8:
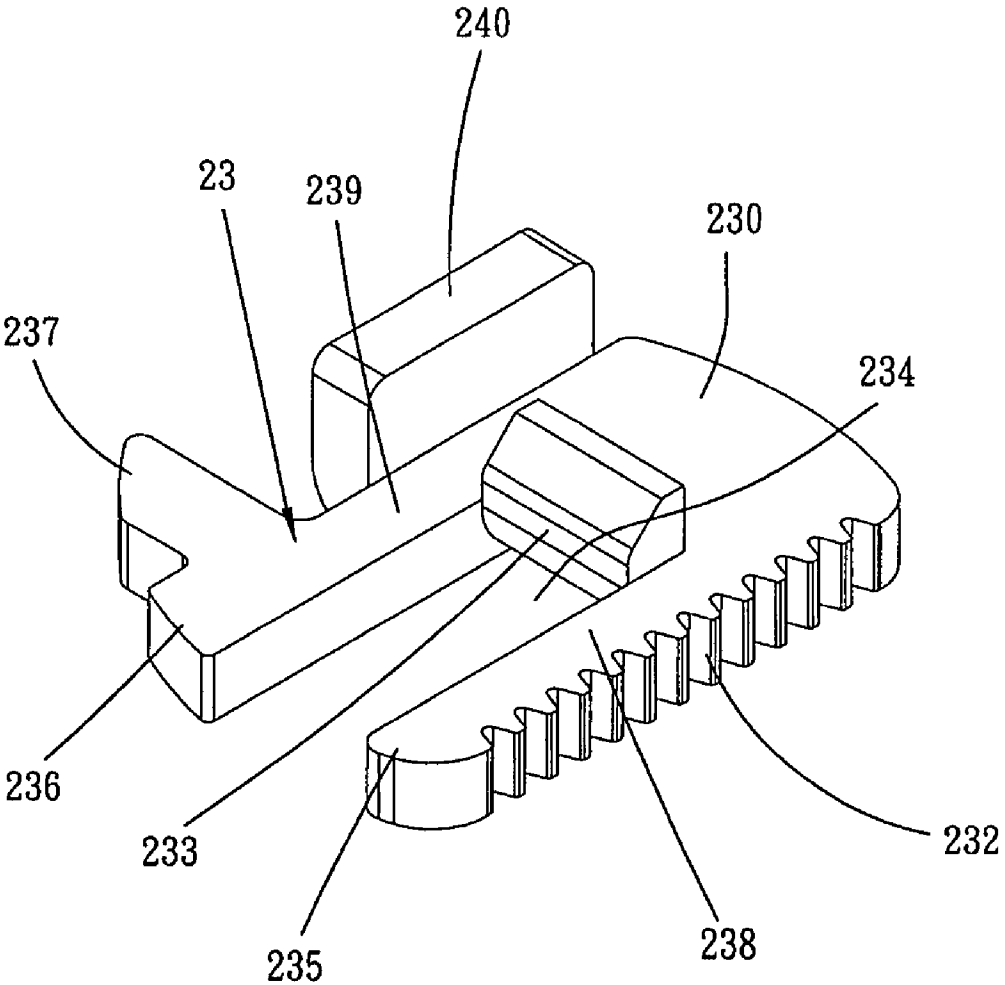
FIG. 8 is a perspective view of a tumbler piece.
Figure 9:
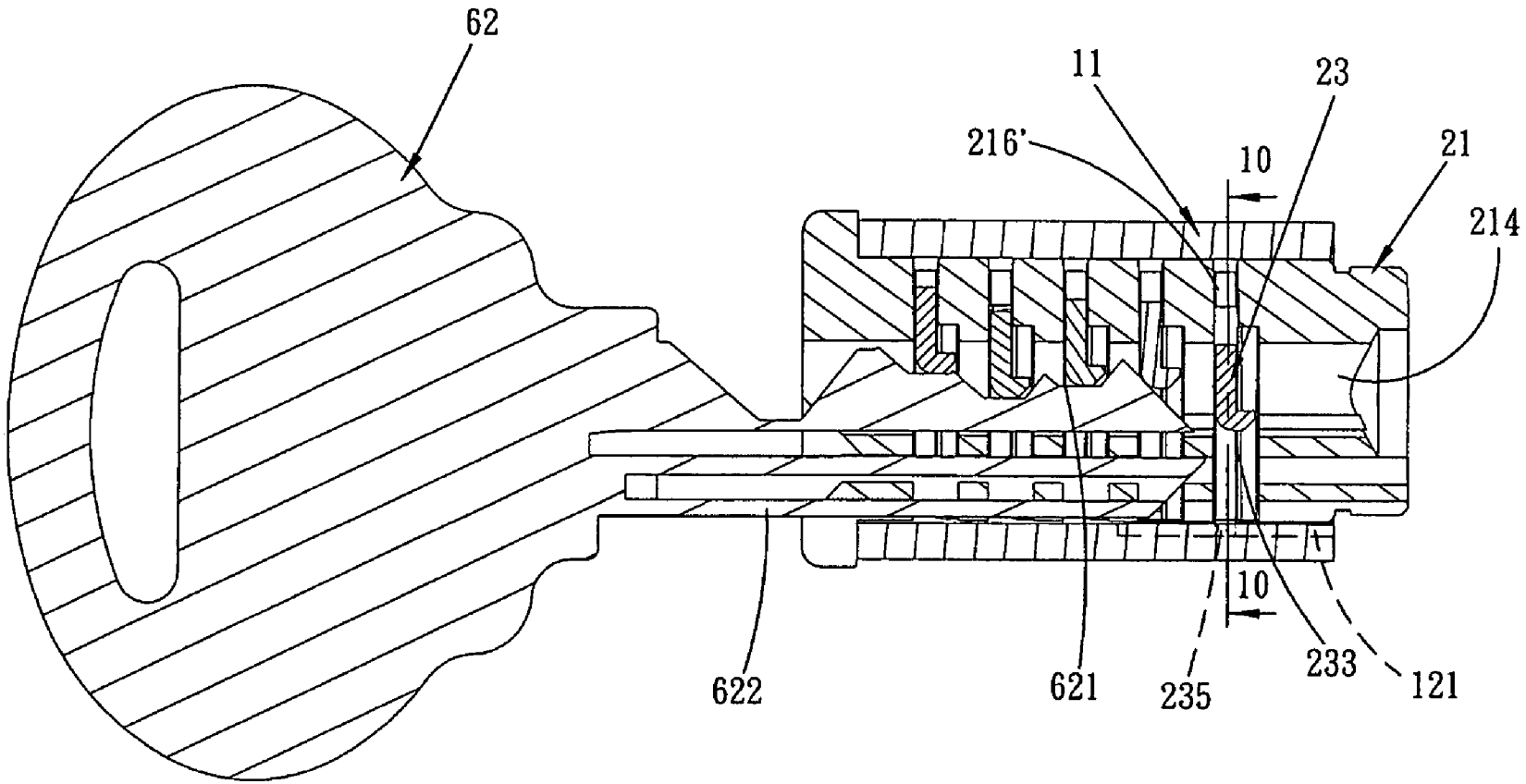
FIG. 9 is a sectional view of the cylinder lock of FIG. 7.

Referring to FIGS. 7-12, there is shown a second preferred embodiment of the present invention which is incorporated into the cylinder lock (A). FIG. 8 shows that each tumbler piece 23 has a middle part 230, a key contact side 233, two legs 238, 239 projecting from the middle part 230 and confining therebetween a key passage 234, and a biasing spring 24 biasing a tab 237 projecting from the leg 239. The toothed part 232 of each tumbler piece 23 is provided on the leg 238.

The second preferred embodiment differs from the first preferred embodiment in that the limit unit of the present invention is one of the tumbler pieces 23 inserted into the radial hole 216'. The limit unit in this embodiment thus has the toothed part 232. Ends of the legs 238, 239 are used as the second engaging elements 235, 236 for engaging the first engaging elements 121, 122 formed in the inner surface 114 of the housing 11.

Referring back to FIGS. 9 and 10, when the key bit 622 of the replacement key 62 is not properly inserted into the key hole 214, or does not reach a predetermined depth of the key hole 214, the limit unit or the tumbler piece 23 is not pushed by a groove 621 of the key bit 622 so that the second engaging elements 235, 236 are in engagement with the respective first engaging elements 121, 122. The plug 21 is thus prevented from rotating when the replacement key 62 is turned.

Referring back to FIGS. 11-12, when the key bit 622 of the replacement key 62 reaches a desired depth of the key hole 214, the key bit 622 pushes the tumbler piece 23 upward so that the second engaging elements 235, 236 disengage from the respective first engaging elements 121, 122. Therefore, the plug 21 can be rotated by turning the replacement key 62.

Referring back to FIG. 8, each tumbler piece 23 further has a guide part 240 that guides the tumbler piece 23 to slide smoothly along the respective radial hole 216.

Figure 13:
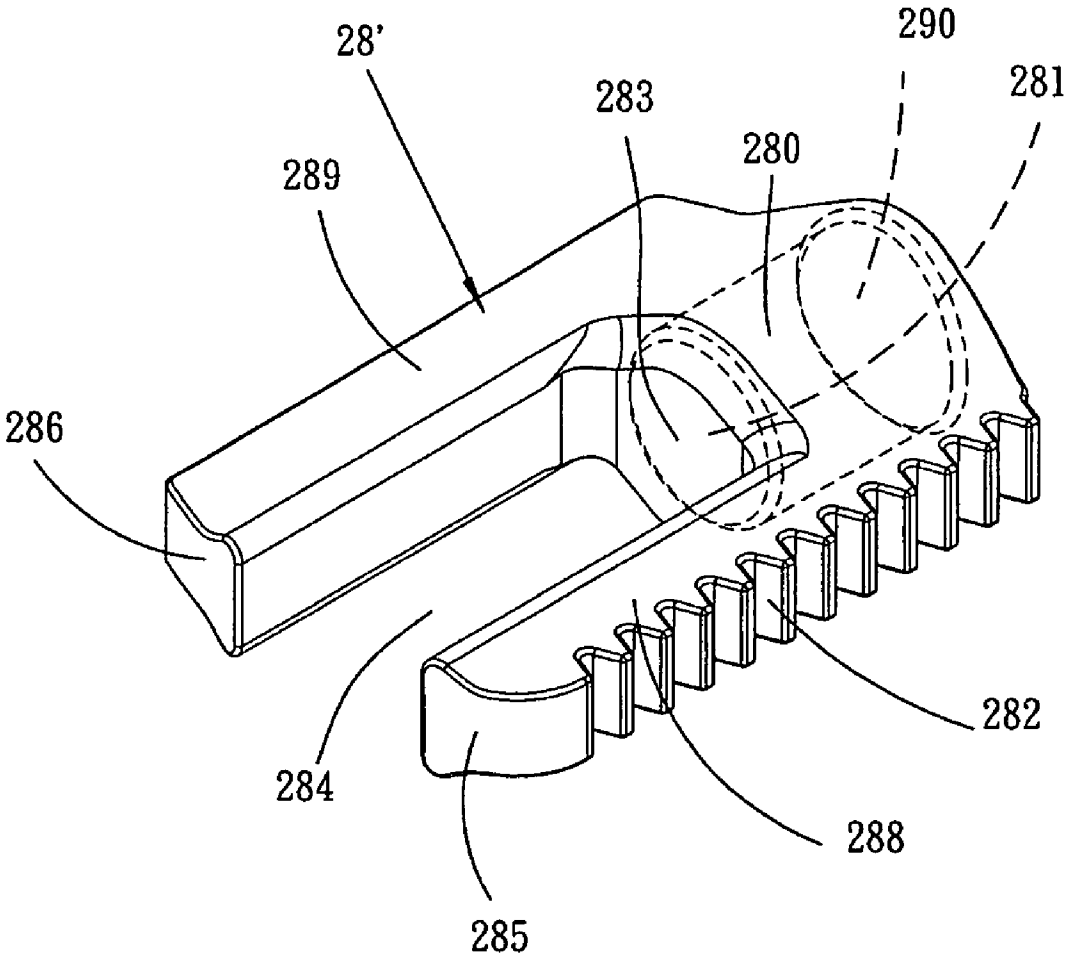
FIG. 13 is a perspective view of an alternative tumbler piece.

Referring to FIG. 13, an alternative of the limit unit according to the present invention is denoted by numeral 28' and has a construction substantially similar to that of the limit unit 28 except that the limit unit 28' has a toothed part 282.

Although the preferred embodiments of the limit unit according to the present invention are illustrated in conjunction with the re-keyable cylinder locks disclosed in the above-mentioned co-pending application of the applicant, application of the limit unit should not be limited thereto. The limit unit of the present invention may also be embodied in other re-keyable cylinder locks which can be re-keyed using a replacement key without disassembling component parts of the cylinder locks.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A cylinder lock that can be re-keyed using a replacement key to replace an old key, said cylinder lock comprising: a lock housing having a plug hole, and at least one first engaging element; a plug inserted into said plug hole, and having an axially extending key hole, and a plurality of radial holes connected to said key hole, one of said radial holes being located at a predetermined depth of said key hole; a plurality of tumbler pieces inserted into said radial holes except said one of said radial holes and each having a toothed part; a re-keying unit disposed within said plug hole adjacent said plug, said re-keying unit being movable relative to said plug between a first position in which said re-keying unit engages said toothed parts of said tumbler pieces to position said tumbler pieces, and a second position in which said re-keying unit disengages from said toothed parts to permit said tumbler pieces to change in position; and a limit unit inserted into said one of said radial holes and having at least one second engaging element; said first engaging element being engageable with said second engaging element when said re-keying unit in said second position so that said plug is prevented from rotating when the replacement key which is inserted into said key hole for re-keying does not reach the predetermined depth of said key hole, wherein said first engaging element is provided on an inner surface of said housing, said one of said radial holes and said first engaging element being disposed on two opposite sides of said key hole, said limit unit being normally biased to move toward said first engaging element so that said second engaging element engages said first engaging element, and wherein said limit unit is slidable radially in said one of said radial holes and said key hole, said limit unit having a middle part, two opposite legs projecting from said middle part and defining a key passage therebetween, a key contact side disposed on said middle part adjacent said key passage, and a biasing spring biasing said middle part, said limit unit including a pair of said second engaging elements provided on said legs, respectively.

2. The cylinder lock of claim 1, wherein said limit unit further has a toothed part engageable with said re-keying unit.

3. The cylinder lock of claim 2, wherein said re-keying unit has a plurality of gear wheels respectively engaging said toothed parts of said tumbler pieces and said limit unit.

4. The cylinder lock of claim 1, wherein the replacement key has a slanting end face to push said limit unit so that said second engaging element is disengaged from said first engaging element when the replacement key reaches the predetermined depth of said key hole.

5. The cylinder lock of claim 1, wherein the replacement key has a slanting end face to push said key contact side of said limit unit so that said second engaging element is disengaged from said first engaging element when the replacement key reaches the predetermined depth of said key hole.

6. A cylinder lock comprising: a lock housing having an inner surface that confines a plug hole and that is provided with at least one first engaging element; a plug inserted into said plug hole and having an axially extending keyhole, and a plurality of radial holes connected to said key hole, one of said radial holes being located at a predetermined depth of said key hole, said key hole having an axially extending open end facing said inner surface of said housing; a plurality of tumbler pieces disposed movably in said radial holes except said one of said radial holes, each of said tumbler pieces having a toothed part; a re-keying unit engageable with said toothed parts of said tumbler pieces; and a limit unit movable within said one of said radial holes and said key hole and having at least one second engaging element; said first engaging element being proximate to said axially extending open end; said second engaging element being extendable through said axially extending open end to engage said first engaging element so that said plug is prevented from rotating, wherein said limit unit is biased to move radially in said one of said radial holes and said key hole, said limit unit having a middle part adapted to be pushed by a key, two opposite legs projecting from said middle part and defining a key passage therebetween, a key contact side disposed on said middle part and adjacent said key passage, and a biasing spring biasing said middle part, a pair of said second engaging elements being provided on said legs, respectively.

7. The cylinder lock of claim 6, wherein said limit unit further has a toothed part engageable with said re-keying unit.

8. The cylinder lock of claim 7, wherein said re-keying unit includes a plurality of gear wheels respectively engaging said toothed parts of said tumbler pieces and said limit unit.

9. The cylinder lock of claim 6, further comprising a replacement key which is inserted into said key hole for re-keying, said replacement key having a slanting end face to push said key contact side of said limit unit so that said second engaging element is disengaged from said first engaging element when said replacement key reaches the predetermined depth of said key hole.

* * * * *